US005474461A

United States Patent [19]

Saito et al.

[11] Patent Number: 5,474,461

[45] Date of Patent: Dec. 12, 1995

[54] LEVER-OPERATED CONNECTOR

[75] Inventors: Masashi Saito; Hisashi Konoya, both of Yokkaichi, Japan

[73] Assignee: Sumitomo Wiring Systems, Ltd., Yokkaichi, Japan

[21] Appl. No.: 157,539

[22] Filed: Nov. 26, 1993

[30] Foreign Application Priority Data

| | | | |
|---|---|---|---|
| Nov. 27, 1992 | [JP] | Japan | 4-087679 U |
| Dec. 1, 1992 | [JP] | Japan | 4-089541 U |

[51] Int. Cl.[6] ..... H01R 13/62

[52] U.S. Cl. ..... 439/157; 439/351

[58] Field of Search ..... 439/152–160, 439/372, 350, 351

[56] References Cited

U.S. PATENT DOCUMENTS

| | | | |
|---|---|---|---|
| 4,634,204 | 1/1987 | Detter et al. . | |
| 4,714,433 | 12/1987 | Rider, Jr. . | |
| 5,104,330 | 4/1992 | Yagi et al. | 439/157 |
| 5,139,430 | 8/1993 | Lewis et al. | 439/157 |
| 5,269,696 | 12/1993 | Okada et al. | 439/140 |
| 5,330,362 | 7/1994 | Ito et aL. | 439/157 |
| 5,344,194 | 9/1994 | Hatagishi et al. | 285/26 |
| 5,373,419 | 12/1994 | Wright | 361/755 |

FOREIGN PATENT DOCUMENTS

| | | | |
|---|---|---|---|
| 0568018 | 11/1993 | European Pat. Off. . | |
| 1590736 | 6/1970 | Germany . | |
| 3527916 | 2/1987 | Germany . | |
| 4-62772 | 2/1992 | Japan . | |
| 5003059 | 8/1993 | Japan . | |
| 2179506 | 3/1987 | United Kingdom . | |
| 2260865 | 4/1993 | United Kingdom | 439/157 |

*Primary Examiner*—David L. Pirlot
*Assistant Examiner*—Jill DeMello
*Attorney, Agent, or Firm*—Oliff & Berridge

[57] ABSTRACT

A lever-operated connector includes a pair of connector housings displaced toward each other to be connected together by rotationally moving a lever form an open position to connected position, a cam follower portion provided on one connector housing, the lever rotatably mounted on the other connector housing, a lever lock portion, and a return spring. The lock portion has a retaining pawl provided on the one connector and a retained portion provided on the lever. The cam portion has a play region for allowing the lever to return a predetermined angle from the connected position toward the open position. A surface on which the retained portion is engaged with the retaining pawl is inclined in such a direction as to hamper retraction of the retaining pawl. Furthermore, the lever is automatically brought into a upstanding condition by the return spring.

6 Claims, 10 Drawing Sheets

LEVER-OPERATED CONNECTOR

BACKGROUND OF THE INVENTION

This invention relates to an improved lever-operated connector in which connector housings are connected together through leverage.

A connector of this type has an advantage that the connection and disconnection can be effected with a small force, and this concept has been applied particularly to multi-terminal connectors. Its basic principle is based on the action of leverage, and such a conventional construction disclosed, for example, in Unexamined Japanese Patent Publication No. Hei. 4-62772 is broadly as follows.

A typical construction of a conventional connector shown in FIGS. 14 and 15, for example, is known. On the left side of FIG. 14 is a female connector housing 1 arranging more than one female terminals (not shown), whereas on the right side thereof is a male connector housing 2 arranging more than one male terminals (not shown) and having a hood portion 2*a* for accommodating the female connector housing 1. Cam follower pins 3 are projected from opposite (right and left) side walls of the female connector housing 1, and guide grooves 4 for receiving the cam follower pins 3 are formed in opposite (right and left) side walls of the hood portion 2*a* of the male connector housing 2.

A lever 5 is rotatably supported by the male connector housing 2 so that the lever 5 can turn between an open position shown in FIG. 14 to a connected position shown in FIG. 15 around pivot pins 2*b* projected from the side walls of the male connector housing 2. Cam grooves 6 to be engaged with the cam follower pins 3 are formed in the inner surfaces of the lever 5. The cam grooves 6 are inclined so that the cam follower pins 3 can enter deep into the hood portion 2*a* of the male connector housing 2 in association with the pivotal movement of the lever 5. The female connector housing 1 is inserted into the hood portion 2*a* of the male connector housing 2 from a state shown in FIG. 14, and the lever 5 is turned in a direction of an arrow in FIG. 14. As a result, the cam follower pins 3 and hence the female connector housing 1 enter deep into the hood portion 2*a* by leverage through the cam grooves 6 in the lever 5, thereby completing the connection of both connector housings in a state shown in FIG. 15.

To ensure such connection of the connector housings, a lock mechanism that locks the lever 5 in the connected position is arranged. Details of the lock mechanism is as shown in FIGS. 16A and 16B. A distal end portion of the lever 5 is hollowed out square to form a retained portion 7, and a retaining pawl 8 is formed in a distal end portion of the female connector housing 1 so that the return of the lever 5 toward the open position can be prevented with the retaining pawl 8 engaged with the retained portion 7. This retaining pawl 8 is designed so as to turn in a direction of an arrow in FIG. 16A elastically through an elastic leg 9. By pressing a distal end portion 8a of the retaining pawl 8 by a finger, the retaining pawl 8 is turned to release its engagement with the retained portion 7.

The surface on which the retained portion 7 engaged with the retaining pawl 8 has conventionally been defined in such a shape that the bottom surface of the retaining pawl 8 is simply extended flat as shown in FIGS. 16A and 16B.

However, the above-mentioned conventional structure is disadvantageous in that if a strong turning force toward the open position is exerted on the lever 5 that is in the connected position, the retaining pawl 8 is raised by the lower surface of the retained portion 7, which then causes the elastic leg 9 to be deformed elastically so as to get away from the retained portion 7. This readily puts the retaining pawl 8 in a retracting portion as shown in FIG. 16B. As a result, the engagement between the retained portion 7 and the retaining pawl 8 is to be released more readily, which does not allow the lever 5 locking function to be performed adequately, and causes the connector housings to be disconnected undesirably.

Another construction of the conventional lever-operated connector is shown in FIGS. 17A to 17D. Many male terminals are arranged in a male connector housing 101, and many female terminals are arranged in a female connector housing 102 to be inserted into the male connector. A lever 103 having a cam groove 103*a* for effecting leverage is rotatably mounted on the male connector housing 101, and a cover 104 having an engagement projection 104*a* is attached to the female connector housing 102. For connecting the two connector housings 101 and 102 together, the engagement projection 104*a* is engaged in the cam groove 103*a* in the lever 103 as shown in FIG. 17B, and in this condition the lever 103 is rotationally moved in a direction of an arrow described in FIG. 17B, so that the cover 104 and hence the female connector housing 102 are displaced toward the male connector housing 101 by leverage through the cam groove 103*a*, therefore the two connector housings connect together.

In the above-mentioned construction, the cam groove 103*a* in the lever 103 is smoothly curved to be gradually changed in curvature so that the lever 103 can impart a downward displacing force to the engagement projection 104*a* at any point through the angle of rotational movement of the lever 103 from an open position (FIG. 17B) to the connected position (FIG. 17D).

In this construction, for disconnecting the two connector housings form each other, the lever lock mechanism is first released to allow the rotational movement of the lever 103, and then the finger is put on the distal end portion of the lever 103, and then the lever is turned upward.

However, in this operation, even when the locking by the lever lock mechanism is released, the lever is not automatically moved to a position where the finger can be easily put on the lever. Therefore, the connector housings 101 and 102 are held with one hand, and the lever 103 is forcibly turned with the finger of the other hand in this condition. Thus, this operation can never be effected with one hand. Therefore, after the connector is incorporated into a narrow space in an equipment, there has been encountered a problem that it is quite difficult to disconnect the connector.

The prevent invention has been accomplished under the above circumstances, and an object of the invention is to provide a lever-operated connector which can lock a lever in a connected position surely and whose function for preventing the disconnection of connectors is excellent.

Another object of the invention is to provide a lever-operated connector in which connectors can be easily disconnected from each other when the locking is released.

SUMMARY

In order to achieve the other object, the present invention provides a lever-operated connector including a pair of connector housings displaced toward each other to be connected together by rotationally moving a lever from an open position to a connected position, a cam follower portion provided on one connector housing for engagement with a cam portion, the lever rotatably mounted on the other connector housing, and a lever lock portion for retaining the lever in the connected position. The lock portion has a retaining pawl provided on the one connector and a retained portion provided on the lever. A surface on which the retained portion is engaged with the retaining pawl is inclined in such a direction as to hamper retraction of the retaining pawl.

In the construction according to the present invention, let it be assumed that a turning force toward the open position is imparted to the lever when the lever is in the connected position. However, the surface on which the retained portion is engaged with the retaining pawl is inclined in such a direction as to hamper retraction of the retaining pawl. Therefore, the retraction of the retaining pawl from the engaged position is controlled, thereby not readily allowing the engagement to be released.

If the retaining pawl is elastically retracted from the engaged position by operating the retaining pawl, the retaining pawl is disengaged from the retained portion, so that the lever is allowed to rotate toward the open position.

As described above, in the lever-operated connector of the present invention, even if a force is exerted on the lever so that the lever in the connected position is displaced toward the open position, the retraction of the retaining pawl from the engaged position can be prevented. Therefore, the locking of the lever in the connected position is ensured, thereby contributing to significantly improving the function for preventing the disconnection of the connectors.

In order to achieve the other object, the present invention provides a lever-operated connector which includes a pair of connector housings displaced toward each other to be connected together by rotationally moving a lever from an open position to a connected position. The lever-operated connector further includes a cam follower portion provided on one connector housing for engagement with a cam portion, a lever rotatably mounted on the other connector housing, a lever lock portion for retaining the lever in the connected position, and a return spring for urging the lever toward the open position. Furthermore, the cam portion has a play region for allowing the lever to return a predetermined angle from the connected position toward the open position. The lever is automatically brought into a upstanding condition when the lever is released from the lock portion by urging force of the return spring.

When the two connector housings are connected together, with the lever disposed in the connected position, the lever is urged toward the open position by the return spring. However, the lever is held in the connected position by the lever lock portion.

In this condition, when the engagement of the lever by the lever lock portion is released, the lever tends to be turned toward the open position by the return spring.

In the case of the conventional lever-operated connector, the cam groove 103*a* of the lever 103 is smoothly curved such that the lever always imparts a downward displacing force to the engagement projection 104*a*, and therefore even when the lever is disposed near to the connected position, the engagement projection is still engaged with the cam groove 103*a* of the lever 103. Therefore, even if the lever is urged toward the open position by a return spring, the lever will not be returned from the connected position toward the open position.

In contrast, in the lever-operated connector according to the present invention, the cam portion of the lever has the play region which allows the lever to return the predetermined angle from the connected position toward the open position. Therefore when the engagement of the lever by the lever lock portion is released, the lever is rotationally returned the predetermined angle by the force of the return spring. As a result, the lever is disposed in a slightly upstanding condition, and then the finger is put on the lever, so that the lever can be easily turned.

As described above, in the lever-operated connector of the present invention, when the locking by the lever lock portion is released, the lever is automatically returned rotationally the predetermined angle, so that the finger can be easily engaged with the lever, thus providing an excellent advantage that the disconnection of the connector can be effected quite easily.

DETAILED DESCRIPTION OF THE PREFERRED EMBODIMENTS

One preferred embodiment of the present invention will now be described with reference to FIGS. 1 to 5.

Figure 2:
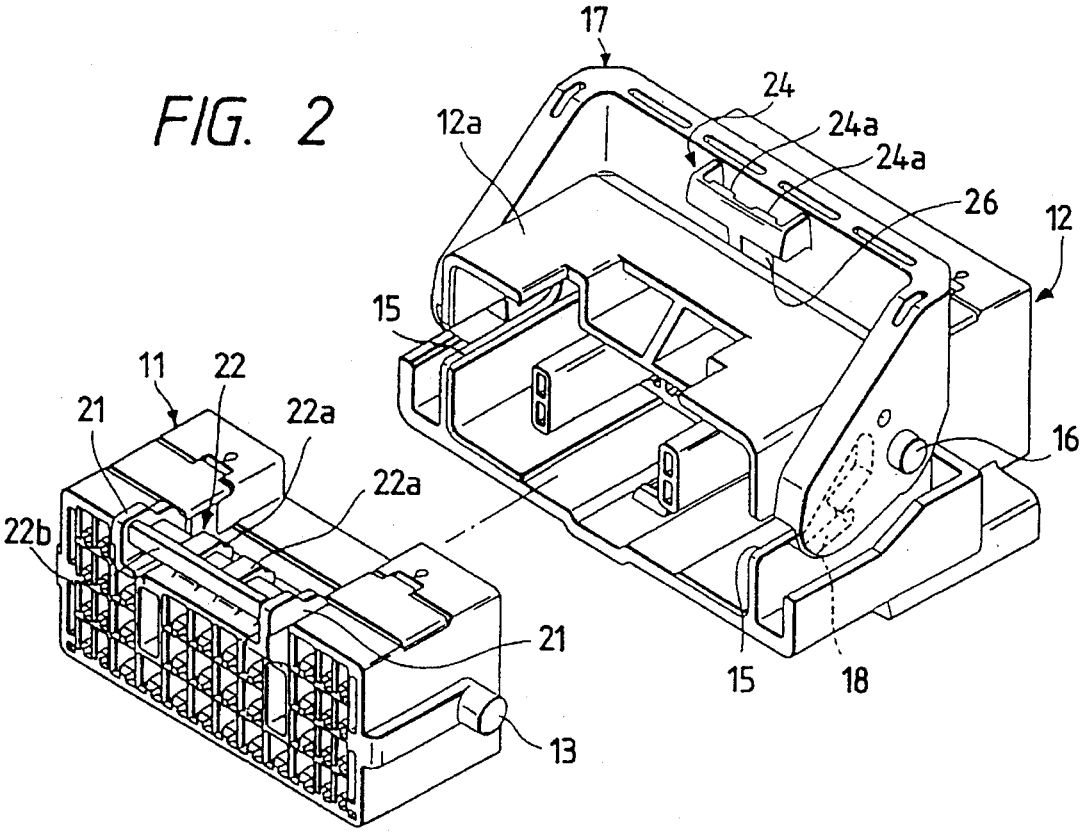
FIG. 2 is a perspective view of an overall construction.
Figure 3:
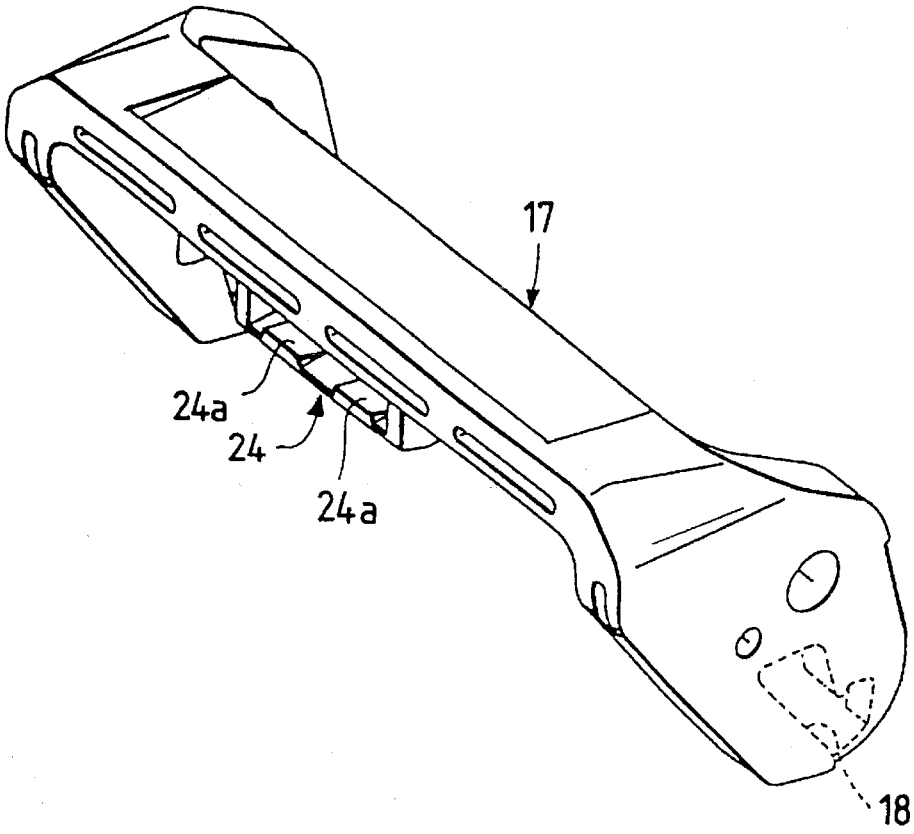
FIG. 3 is a perspective view of a lever.
Figure 4:
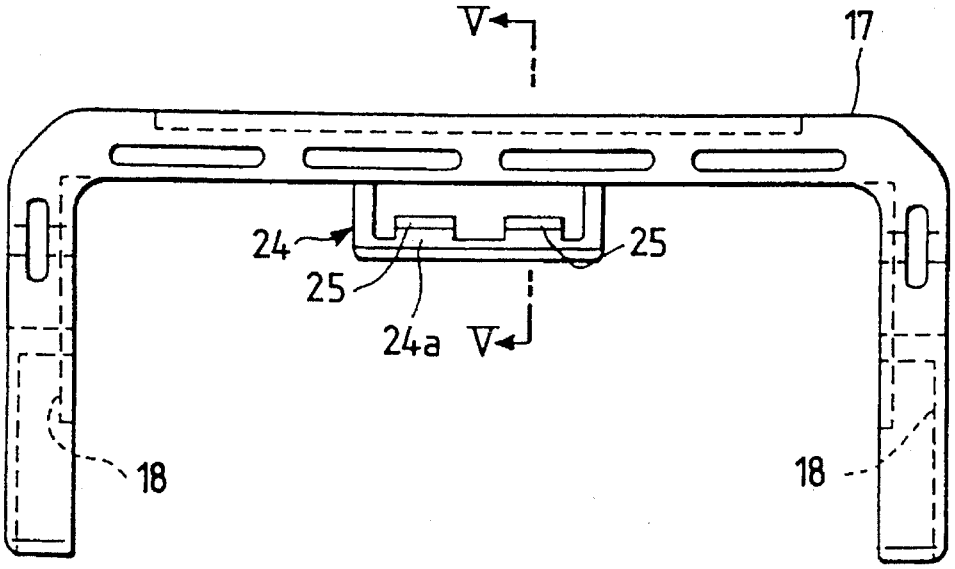
FIG. 4 is a front view of the lever.
Figure 5:
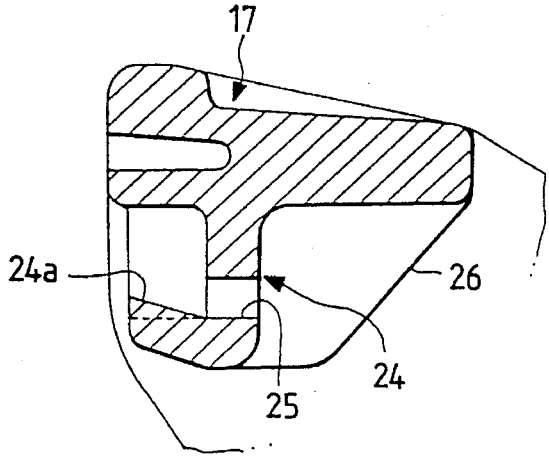
FIG. 5 is a sectional view taken along a line V—V of FIG. 4.

FIG. 2 shows overall construction according to the present invention. A female connector housing 11 having not shown female terminals is shown on the left side of FIG. 2, and a male connector housing 12 having male terminals not shown and a hood portion 12*a* into which the female connector housing 11 can be inserted is shown on the right side thereof.

The female connector housing 11 is of such a size that it can be inserted into the hood portion 12*a* of the male connector housing 12. A pair of cam follower pins 13 corresponding to cam follower portions (only one of which is shown) are formed on and projected laterally from opposite (right and left) sides of the female connector housing 11, respectively.

A pair of guide grooves 15 are formed respectively on opposite (right and left) sides of the male connector housing 12. When the female connector housing 11 is fitted on the male connector housing, the cam follower pins 13 are received in the guide grooves 15, respectively. A pair of pivot pins 16 (only one of which is shown) are formed on and projected laterally from the opposite (right and left) sides of the male connector housing 12, respectively. A U-shaped lever 17 is rotatably supported on the pivot pins 16. Cam grooves 18 serving as cam portions are formed respectively so as to be hollowed out in the inner surfaces of the opposite sides of the lever 17 (on the male connector housing 12 side). When the female connector housing 11 is fitted, the cam follower pins 13 are received and engaged in the cam grooves 18, respectively. During the pivotal movement of the lever 17 from an open position shown in FIG. 2 to a connected position shown in FIG. 1 with the cam follower pins 13 having entered into the cam grooves 18, the cam follower pins 13 and hence the female connector housing 11 are displaced toward the hood portion 12*a* of the male connector housing 12 by leverage. Thus, the cam grooves 18 have the function of connecting the two connector housings together with the female and male terminals connected. While not shown, in an inner surface of the lever 17 is a coil spring, which urges the lever 17 to the open position.

As shown in FIG. 2, a pair of side walls 21 are projected from the upper surface of the female connector housing 11 so as to confront each other. Interposed between these side walls 21 is a retaining pawl 22, which is projected through an elastic leg 23 (see FIG. 1). Hooking portions 22*a* are projected to the front (toward the right end portion as viewed in FIG. 1) in two positions on the retaining pawl 22. These hooking portions 22*a* are displaced in such a manner that the distal ends of the respective hooking portions 22*a* are raised with the elastic leg 23 elastically deforming in a direction of an arrow when a finger engaging portion 22*b* located on the rear end (on the left end portion as viewed in FIG. 1) of the retaining pawl 22 is pressed down. The lower surface of each hooking portion 22*a* is designed so that the distal end thereof is inclined downward.

On the other hand, a retained portion 24 to be engaged with the retaining pawl 22 is formed in the middle of the distal end of the lever 17. The retained portion 24 is formed integrally with the lever 17 in box-like form, with two inclined surface portions 24*a* projected from the inner surfaces thereof. The respective inclined surface portions 24*a* are arranged so as to correspond to the two hooking portions 22*a* of the retaining pawl 22. The inclination of each inclined surface portion 24*a*, being such that the front side thereof (the left side as viewed in FIG. 1) is inclined upward, fits the angle of inclination of each hooking portion 22*a*. As a result, a surface on which the retained portion 24 is engaged with a retaining pawl 22 (a surface on which the inclined surface portions 24*a* contact the hooking portions 22*a*) is inclined in such a direction as to hamper retraction of the retaining pawl 22. On the rear sides of the respective inclined surface portions 24*a* are punched holes 25. A reinforcing rib 26 is formed between the punched holes 25 integrally with the lever 17.

Figure 1:
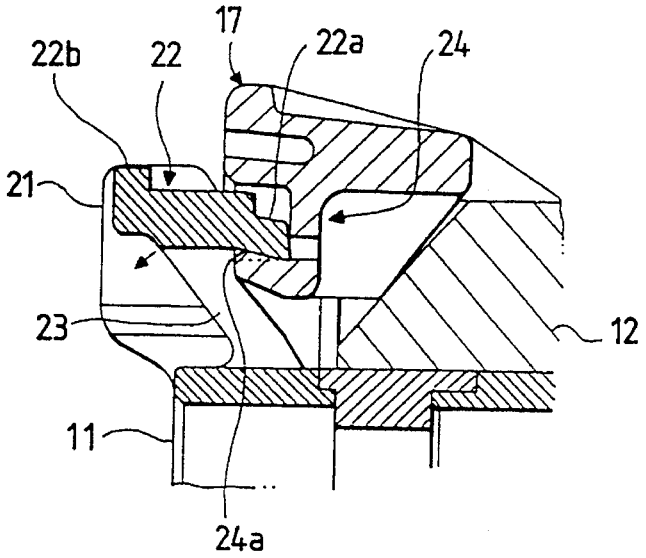
FIG. 1 is a sectional view of a lever lock portion showing an embodiment of the invention.

According to the above-mentioned construction, when the lever 17 is set in the connected position shown in FIG. 1, the hooking portions 22*a* of the retaining pawl 22 are fitted on the inclined surface portions 24*a* of the retained portion 24. As a result, the lever 17 is locked in that engaged position so that its rotational movement in the open position is regulated. To release the locking of the lever 17 from this state, the finger engaging portion 22*b* of the retaining pawl 22 is pressed down with a finger engaged therewith. As a result, the elastic leg 23 is elastically deformed as shown by an arrow in FIG. 1, causing the retaining pawl 22 to retract from the retained portion 24 of the lever 17. The hooking portions 22*a* of the retaining pawl 22 are, in the end, disengaged from the inclined surface portions 24*a* of the retained portion 24 to thereby unlock the lever 17. When the lever 17 is turned toward the open position, the cam follower pins 13 are displaced in a direction opposite to the inserting direction according to pressed by the cam grooves 18 in the lever 17, thereby disconnecting both connectors from each other while pushing the female connector housing 11 out of the hood portion 12*a* of the male connector housing 12.

By the way, the lever 17 may happen to receive strong turning force toward the open position when the lever 17 is locked in the connected position for such a reason as the connectors being moved forcibly through electric wires or the like. In such a case, the retained portion 24 of the lever 17 raises the retaining pawl 22 as is apparent from FIG. 1. However, according to this embodiment, the surface on which the retained portion 24 is engaged with the retaining pawl 22 (the surface on which the inclined surface portions 24*a* contact the hooking portions 22*a*) is inclined in such a direction as to hamper retraction of the retaining pawl 22. Therefore, even if the retaining pawl 22 is raised, the retaining pawl 22 is not displaced easily in the retracting direction (in a direction of an arrow in FIG. 1), thereby maintaining the engagement between the inclined surface portions 24*a* and the hooking portions 22*a*. As a result, the retraction of the retaining pawl 22 from the engaged position is prevented even if a strong force is unexpectedly exerted on the lever 17 that is in the connected position toward the open position, thereby allowing the lever 17 to be locked in the connected position surely, which contributes to greatly improving the function of preventing the connectors from being disconnected from each other.

Another lever-operated connector according to the present invention will now be described with reference to FIGS. 6 to 13.

Figure 6:
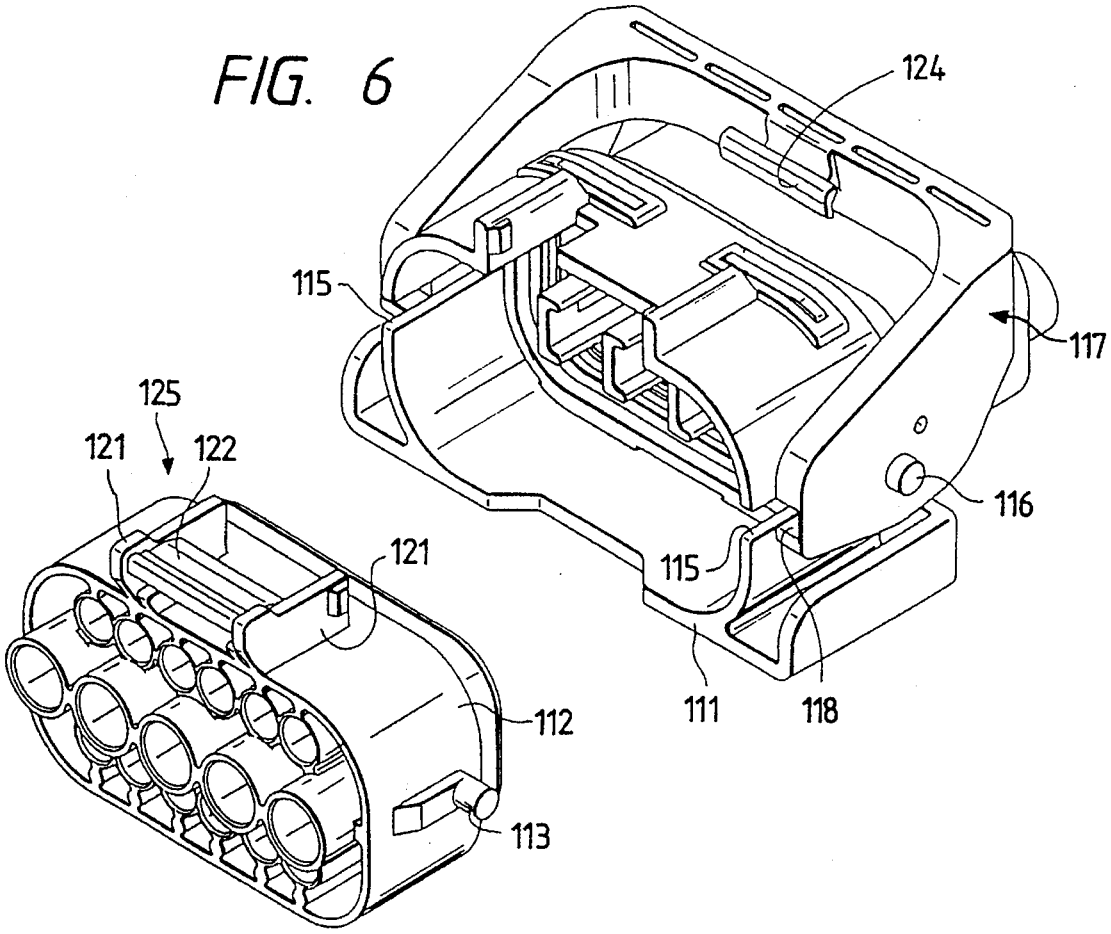
FIG. 6 is a perspective view of an overall construction of one preferred embodiment of the present invention.

FIG. 6 shows an overall construction. A male connector housing 111 having male terminals (not shown) is shown at a right side of FIG. 6, and a female connector housing 112 having female terminals (not shown) is shown at a left side thereof.

The female connector housing 112 is of such a size that it can be inserted into the male connector housing 111. A pair of cam follower pins 113 corresponding to cam follower portions (only one of which is shown) are formed on and projected laterally from opposite (right and left) sides of the female connector housing 112.

Figure 7:
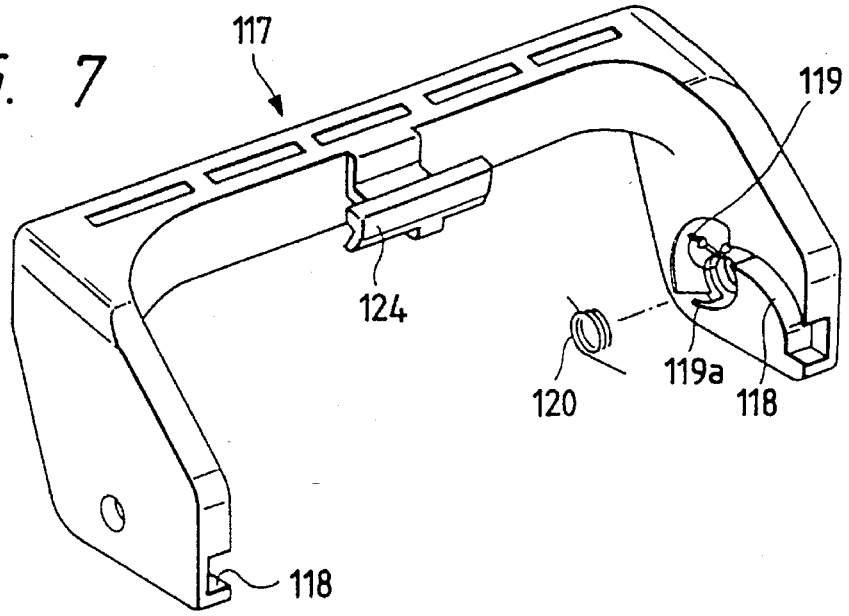
FIG. 7 is a perspective view of a lever.
Figure 9:
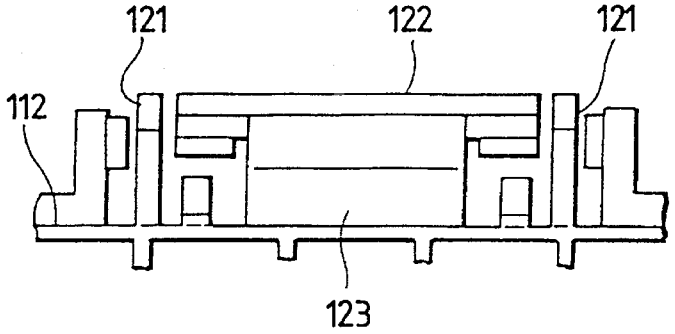
FIG. 9 is a front-elevational view of a lever lock portion.

A pair of guide grooves 115 are formed respectively at opposite (right and left) sides of the male connector housing 111, and when the male connector housing 111 is fitted on the female connector housing 112, the cam follower pins 113 are received in the guide grooves 115, respectively. A pair of pivot pins 116 (only one of which is shown) are formed on and projected laterally from the opposite (right and left) sides of the male connector housing 111, respectively. A U-shaped lever 117 is rotatably supported on the pivot pins 116. Cam grooves 118 serving as cam portions are formed respectively in the inner surfaces of the opposite sides of the lever 117 facing the male connector housing 111, as shown in FIG. 7. When the male connector housing 111 is fitted, the cam follower pins 113 are received and engaged in the cam grooves 118, respectively. The shape of the cam groove 118 will be described later in detail, and as a whole the cam groove 118 has an arc shape whose curvature is gradually changed. During the rotational movement of the lever 117 from an open position (FIG. 6) to a connected position (FIG. 11), the cam follower pins 113 and hence the female connector housing 112 are displaced to be inserted into the male connector housing 111, thereby connecting the two connector housings together.

A spring reception recess 119 is formed at the portion of the side wall of the lever 117 where one pivot pin 116 extends therethrough, and a return spring 120 comprising a coil spring is received in the recess 119. One end portion of the return spring 120 is received in a retaining groove 119*a* extending from the reception recess 119, and the other end portion thereof is retained by a retaining projection (not shown) formed on a side wall of the male connector housing 111. With this arrangement, the lever 117 is normally urged toward the open position by the return spring 120.

Figure 10:
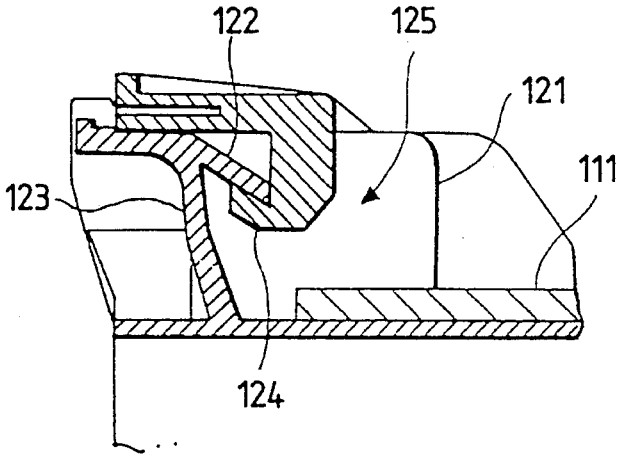
FIG. 10 is a vertical cross-sectional view of the lever lock portion.

As shown in FIG. 6, a retaining pawl 122 is formed on the upper surface of the female connector housing 112 through an elastic leg 123, the retaining pawl 122 being interposed between side walls 121 (see FIG. 10). When the rear end portion (the left portion in FIG. 10) of the retaining pawl 122 is pressed down, the elastic leg 123 is flexed and elastically deformed, so that the distal end portion of the retaining pawl 122 is raised. A retaining projection 124 for engagement with the retaining pawl 122 is formed on the central portion of the lever 117, and a lever lock portion 125 for retaining the lever 117 in the connected position is constituted by these portions.

Figure 8A:
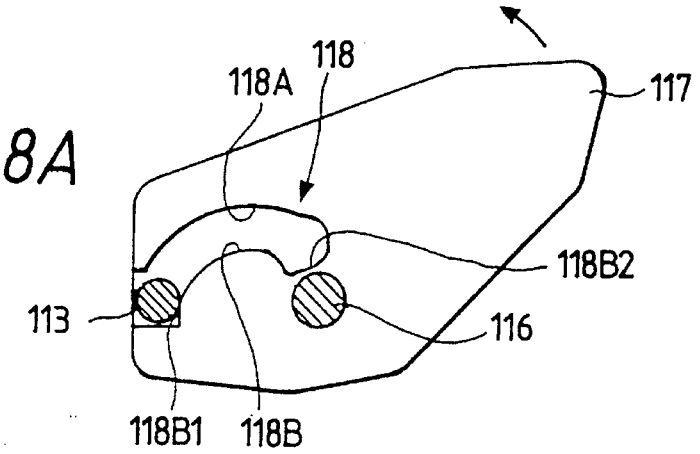
FIGS. 8A to 8C are views showing the process of turning of the lever and the process of movement of an pivot pin.
Figure 8B:
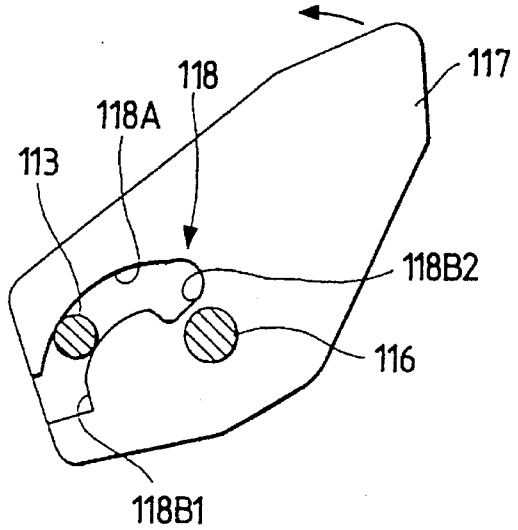
Figure 8C:
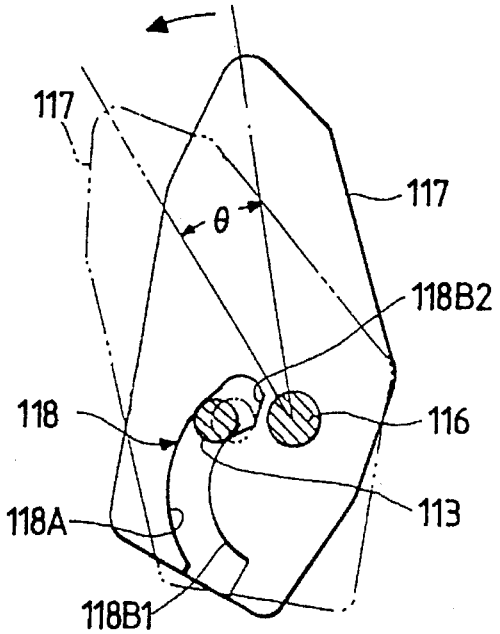

The shape of the cam groove 118 in the lever 117 is shown in detail in FIG. 8. More specifically, the cam groove 118 has a pair of opposed inner surfaces which are arcuate as a whole. And when the female connector housing 112 is to be inserted, one (hereinafter referred to as "insertion-side cam surface 118A") of these inner surfaces is strongly contacted with the cam follower pin 113 to displace this connector housing 112 into the male connector housing 111. When the female connector housing 112 is to be disconnected, the other inner surface (hereinafter referred to as "disconnection-side cam surface 118B") is strongly contacted with the cam follower pin 113 to displace this connector housing 112 away from the male connector housing 111. In this embodiment, the portion 118B1 (an inlet portion for inserting the cam follower pin 113) of the disconnection-side cam surface 118B corresponding to the open position of the lever 117, as well as the portion 118B2 (an end portion to which the cam follower pin 113 can advance deepest) of this cam surface corresponding to the closed position of the lever 117 has a characteristic shape, which will be described later. And the remainder is smoothly continuous and is gradually changing in curvature. Namely, at the portion 118B1 corresponding to the open position of the lever 117 is flat as shown in FIG. 8A. With this arrangement, when the female connector housing 112 is merely inserted into the male connector housing 111, each cam follower pin 113 abuts against the flat portion 118B1, so that a further insertion of the female connector housing is prevented. With respect to the portion 118B2 corresponding to the connected position of the lever 117, a constant curvature portion 118B2 whose curvature is constant is provided at a region lying from this portion to a portion back toward the open position at a predetermined angle θ. With this arrangement, the lever 117 has a play region which allows the lever 117 to return a predetermined angle θ from the connected position toward the open position.

Figure 11:
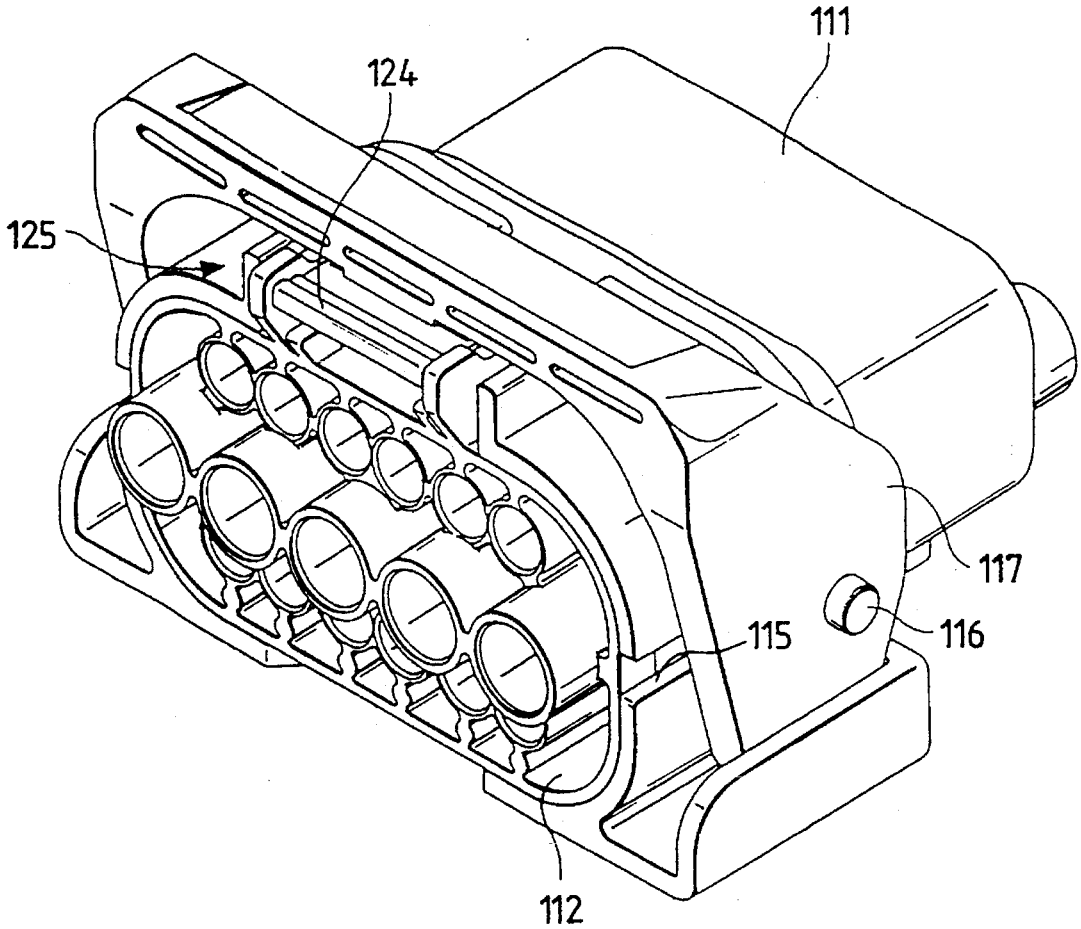
FIG. 11 is a perspective view of the connector in a connected state.

The operation of the above construction will now be described with respect to the case of disconnecting the connected two connectors from each other. Let's assume that the two connectors are in the connected condition as shown in FIG. 11, and that the lever 117 is retained in the connected position by the lever lock portion 125. Even in this case, the lever 117 is urged toward the open position by the return spring 120. However, the lever 117 is prevented by the lever lock portion 125 from being turned toward the open position.

Figure 12:
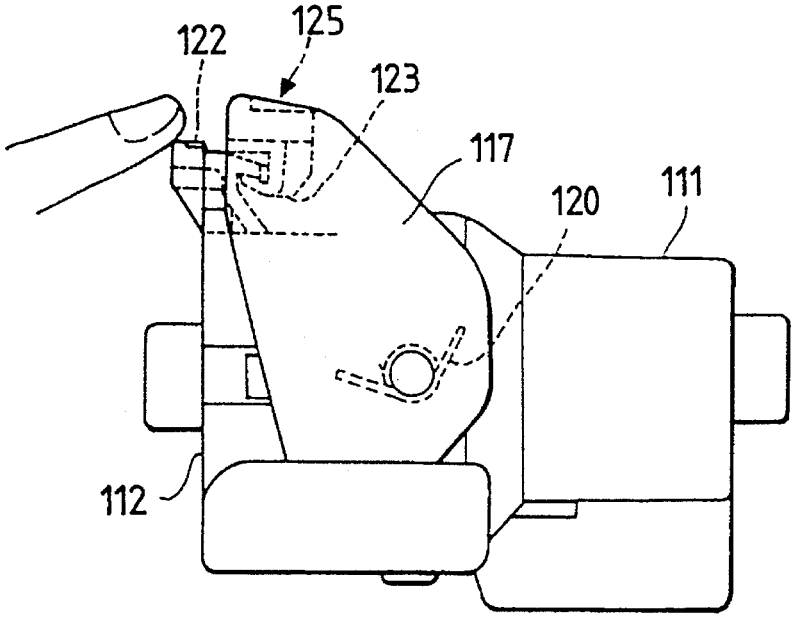
FIG. 12 is a side-elevational view showing the process of a disconnecting operation.
Figure 13:
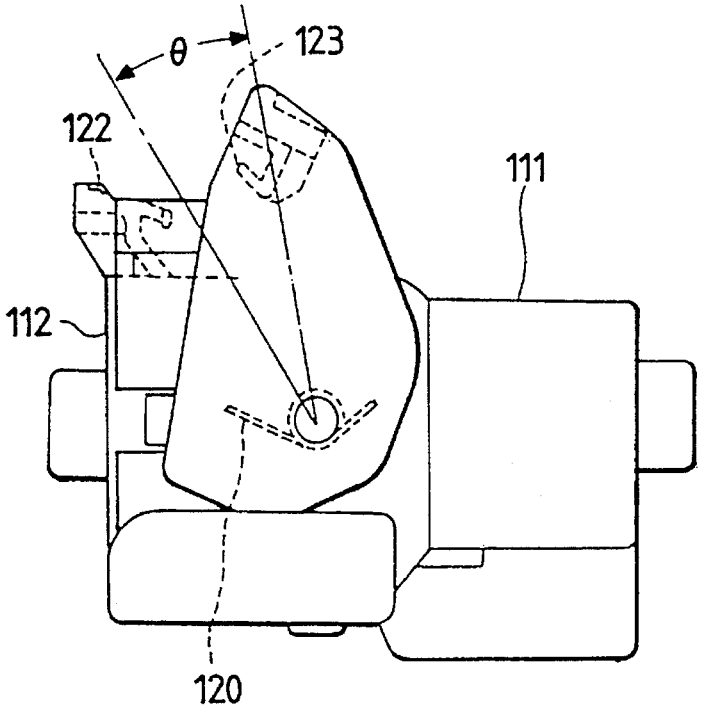
FIG. 13 is a side-elevational view showing the process of the disconnection operation.
Figure 14:
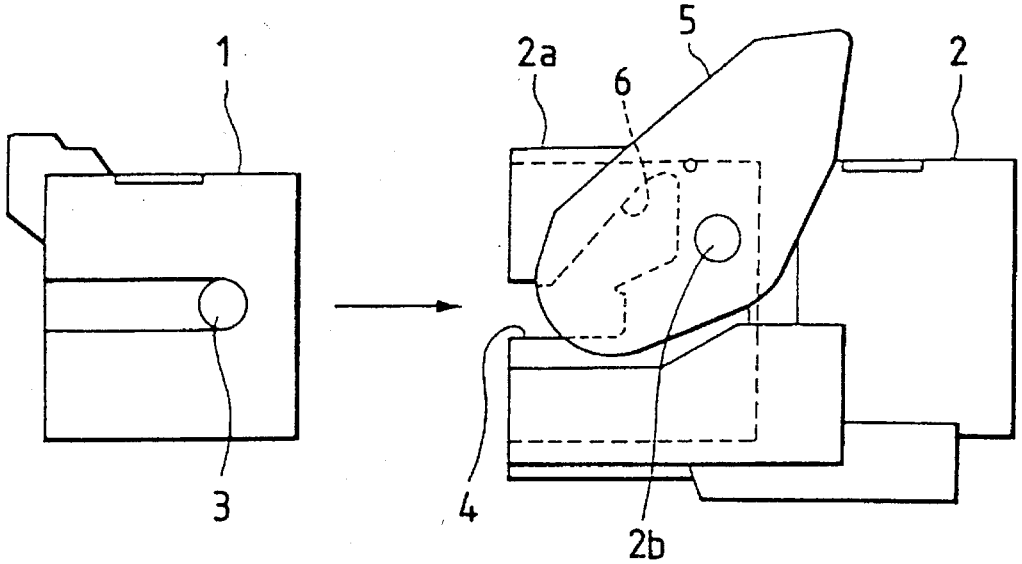
FIG. 14 PRIOR ART
FIG. 14 is a side view showing a conventional lever-operated connector in a disconnected state.
Figure 15:
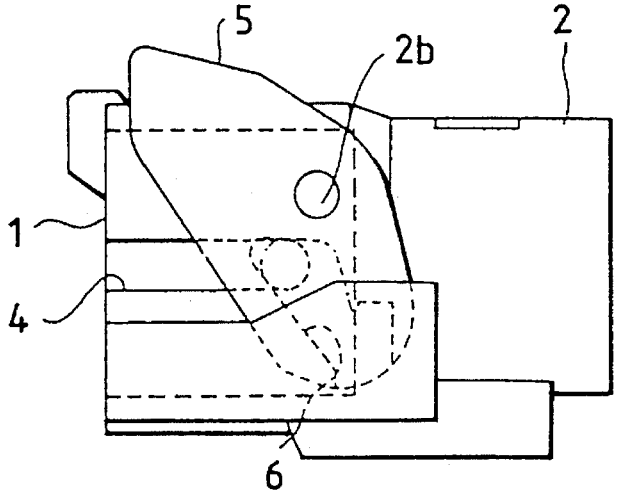
FIG. 15 PRIOR ART
FIG. 15 is a side view showing the conventional lever-operated connector in a connected state.
Figure 16A:
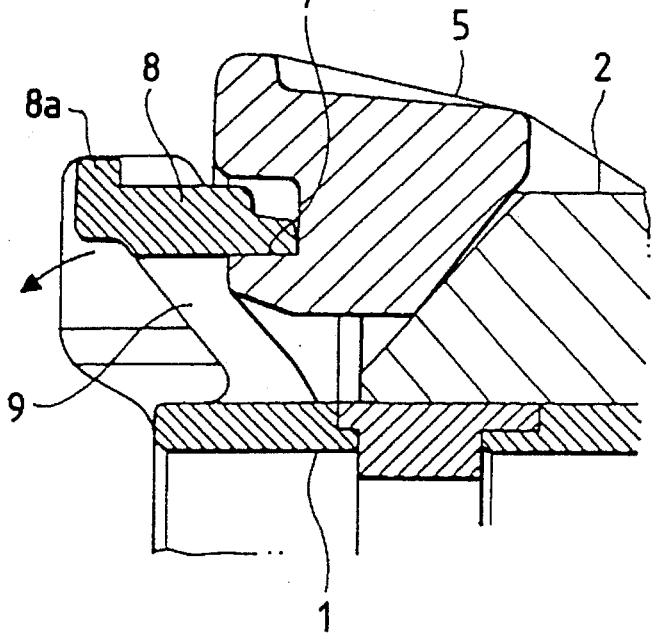
FIG. 16A PRIOR ART
FIGS. 16A and 16B are sectional views showing a conventional structure for locking a lever.
Figure 16B:
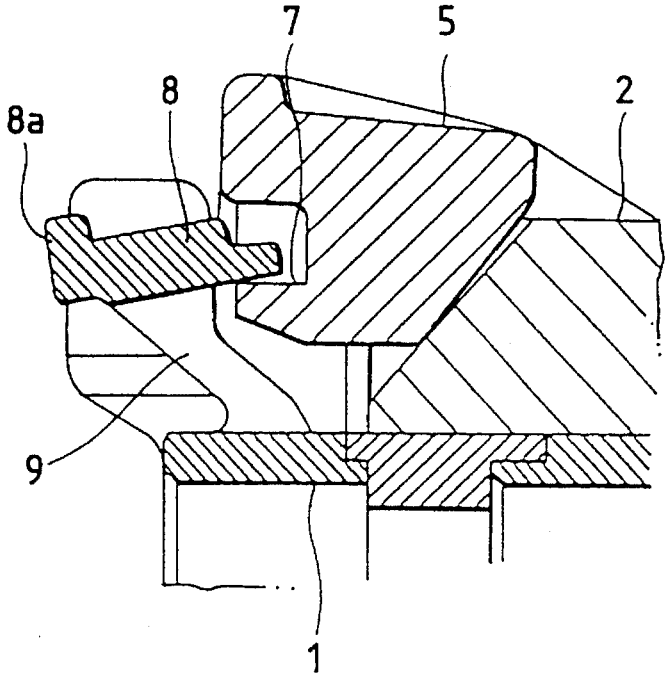
FIG. 16B PRIOR ART
Figure 17A:
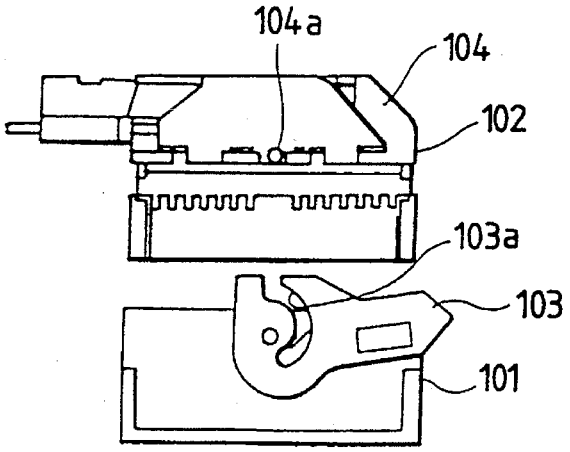
FIG. 17A PRIOR ART
FIGS. 17A to 17D are schematic side-elevational views showing the conventional lever-operated connector.
Figure 17B:
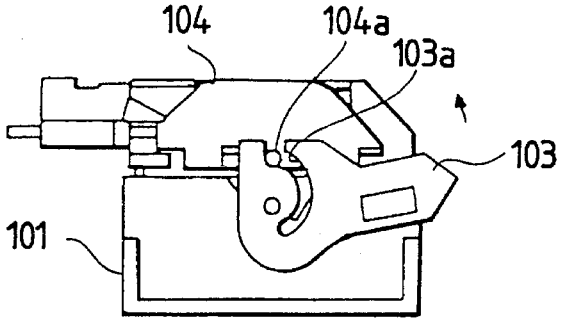
FIG. 17B PRIOR ART
Figure 17C:
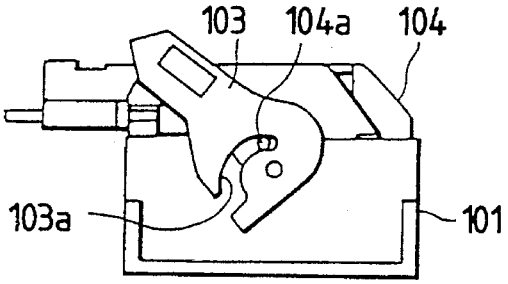
FIG. 17C PRIOR ART
Figure 17D:
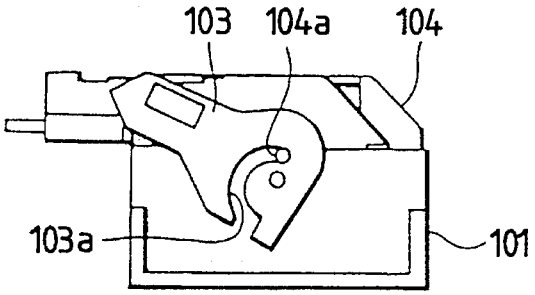
FIG. 17D PRIOR ART

Here, for example, the thumb is engaged with the rear end portion of the retaining pawl 122 of the lever lock portion 125, as shown in FIG. 12, and presses it down. As a result, the elastic leg 123 is elastically deformed to raise the distal end of the retaining pawl 122, so that the retaining pawl 122 is disengaged from the retaining projection 124 of the lever 117. In this embodiment, the lever 117 is normally urged toward the open position by the return spring 120, and the lever 117 has the play region for allowing the lever to return the predetermined angle from the connected position toward the open position. Therefore, the lever 117 is immediately rotationally returned the predetermined angle under the influence of the return spring 120, then the lever 117 is stopped, as shown in FIG. 13. Therefore, the lever 117 is disposed in a generally upstanding condition as indicated in a solid line in FIG. 13, and a gap is formed between the lever 117 and the upper surface of the male connector housing 111. Therefore, the finger can be readily put on the lever 117 even if the operation is carried out with one hand. In this condition, the disconnection-side cam surface 118B of each cam groove 118 is pressed against the cam follower pin 113, and a frictional force is exerted between the male and female terminals. The finger is put on the distal end of the lever 117, and pulls and turns the lever, so that each cam follower pin 113 of the female connector housing 112 is urged upward by the disconnection-side cam surface 118B of the cam groove 118 to be displaced toward the open position, and the female connector housing 112 is withdrawn from the male connector housing 111. As a result, the female and male terminals are disconnected from each other.

Thus, in this embodiment, for disconnecting the connectors from each other, the finger is first engaged with the retaining pawl 122 to release the locking of the lever 117, so that the lever 117 is automatically brought into a generally upstanding condition. Then, the lever 117 is put on the finger, and is turned. Therefore, even if the connector is mounted in a narrow space in an equipment, it can be disconnected with one hand, and the operation including maintenance can be effected easily.

For connecting the connectors together, the female connector housing 112 is inserted into the male connector housing 111, and the lever 117 is turned into the connected position, and finally the retaining projection 124 of the lever 117 is engaged with the retaining pawl 122, as is the case with the conventional construction. By doing so, each cam follower pin 113 is displaced by the cam groove 118 in the lever 117, so that the female connector housing 112 is brought into the connected position. Therefore, the operability for connecting the connectors together is not adversely affected at all.

The present invention is not limited to the above embodiment, and for example the following modifications can be made.

(a) In the above embodiment, although the lever is provided on the male connector housing while the cam follower pins are provided on the female connector housing, this may be reversed; that is, the lever may be provided on the female connector housing while the cam follower portion may be provided on the male connector housing.

(b) In the above embodiment, although the cam follower pins (cam follower portions) are formed directly on the female connector housing, this is not always necessary. For example, a cam follower portion may be formed on a cover that is to be attached to one connector housing, in such a manner as to be engaged in a cam groove formed in a lever mounted on the other connector housing, and by turning the lever, the cover and hence the connector housing are displaced.

The present invention is not limited to the embodiments described above and shown in the drawings; but the invention may be embodied while modified in various modes within such a range as not to deviate from the material part of the invention.

What is claimed is :

1. A lever-operated connector comprising:

a pair of connector housings displaced toward each other to be connected together by rotationally moving a lever from an open position to a connected position;

a cam follower portion provided on one connector housing for engagement with a cam portion;

said cam portion provided on the other connector housing;

said lever rotatably mounted on the other connector housing; and a lever lock portion for retaining said lever in the connected position;

said lock portion comprising, a retaining pawl provided on said one connector, and a retained portion provided on said lever;

wherein a surface on which said retained portion is engaged with said retaining pawl is inclined in such a direction as to hamper retraction of said retaining pawl.

2. A lever-operated connector according to claim 1, said lever-operated connector further comprising a return spring for urging said lever toward said open position, and said cam portion comprising a play region for allowing said lever to return a predetermined angle from said connected position toward said open position, wherein said lever is automatically brought into a upstanding condition by urging force of said return spring when said lever is released from said lock portion.

3. A lever-operated connector comprising:

a pair of connector housings displaced toward each other to be connected together by rotationally moving a lever from an open position to a connected position;

a cam follower portion provided on one connector housing for engagement with a cam portion;

said cam portion provided on the other connector housing;

said lever rotatably mounted on the other connector housing;

a lever lock portion for retaining said lever in the connected position; and a return spring for urging said lever toward said open position;

said cam portion comprising a play region for allowing said lever to return a predetermined angle from said connected position toward said open position, wherein said lever is automatically brought into an upstanding condition by urging force of said return spring when said lever is released from said lock portion.

4. A lever-operated connector according to claim 3, said return spring comprising a coil spring.

5. A lever-operated connector according to claim 4, a wall of said one connector comprising a retaining projection, and said lever further comprising a spring reception recess, wherein one end portion of said return spring is received in a retaining groove extending from said reception recess, and the other end portion of said spring is retained by said retaining projection.

6. A lever-operated connector according to claim 3, wherein one cam surface is flat at a portion corresponding to the open position, and the other cam surface is formed a constant curvature as said play region of the cam portion at a portion corresponding to the connected position.

* * * * *